US010113288B2

(12) United States Patent
Steff De Verninac et al.

(10) Patent No.: US 10,113,288 B2
(45) Date of Patent: Oct. 30, 2018

(54) CONCRETING FACILITY AND CORRESPONDING CONCRETING METHOD

(71) Applicant: SOLETANCHE FREYSSINET, Rueil Malmaison (FR)

(72) Inventors: Bertrand Steff De Verninac, Rueil Malmaison (FR); Daniel Perpezat, Rueil Malmaison (FR); Christian Auvray, Rueil Malmaison (FR); Lionel Rouffaud, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 15/101,371

(22) PCT Filed: Dec. 3, 2014

(86) PCT No.: PCT/FR2014/053142
§ 371 (c)(1),
(2) Date: Jun. 2, 2016

(87) PCT Pub. No.: WO2015/082838
PCT Pub. Date: Jun. 11, 2015

(65) Prior Publication Data

US 2016/0305084 A1 Oct. 20, 2016

(30) Foreign Application Priority Data

Dec. 3, 2013 (FR) ..... 13 62002

(51) Int. Cl.
*E02D 15/04* (2006.01)
*E02D 7/00* (2006.01)
*E02D 17/13* (2006.01)

(52) U.S. Cl.
CPC ..... *E02D 15/04* (2013.01); *E02D 7/00* (2013.01); *E02D 17/13* (2013.01)

(58) Field of Classification Search
CPC ..... G01B 21/02
See application file for complete search history.

(56) References Cited

U.S. PATENT DOCUMENTS 3,422,629 A * 1/1969 Watts ..... E02D 5/36
175/292

FOREIGN PATENT DOCUMENTS

CN 2778882 Y * 5/2006 ..... E02D 5/034
FR 2432374 A3 2/1980

OTHER PUBLICATIONS

International Search Report dated Feb. 27, 2015, for International Application No. PCT/FR2014/053142, pp. 1-5.

* cited by examiner

*Primary Examiner* — Tara Mayo-Pinnock
(74) *Attorney, Agent, or Firm* — MH2 Technology Law Group, LLP

(57) ABSTRACT

The invention relates to a concreting installation for concreting an excavation. The installation includes a concreting column having a top end arranged to be open in order to be at atmospheric pressure, and at least one controlled retention device situated at a distance from the open top end of the concreting column and adapted, in at least one configuration, to retain a volume of concrete inside the column. The invention also relates to a method of concreting an excavation.

9 Claims, 9 Drawing Sheets

CONCRETING FACILITY AND CORRESPONDING CONCRETING METHOD

CROSS-REFERENCE TO RELATED APPLICATIONS

This application is a U.S. National Stage application of International Application No. PCT/FR2014/053142 filed 3 Dec. 2014, which claims priority to French Application No. 1362002 filed 3 Dec. 2013, the entire disclosures of which are hereby incorporated by reference in their entireties.

TECHNICAL FIELD

The present description relates to the field of special works in ground.

More particularly, it relates to a concreting installation for concreting an excavation and to a method of concreting an excavation.

In particular, the installation and the method of the invention are adapted to making molded elements in the ground, of any general shape, e.g. diaphragm walls and piles.

The installation and the method of the invention are particularly adapted to making deep molded elements.

By way of non-limiting example, they are adapted to making works having a bottom end situated at a depth of more than 100 meters.

BACKGROUND OF THE INVENTION

In certain situations, as when repairing dams, it is necessary to make diaphragm walls to a depth of more than 100 meters.

The operating technique for making such walls is similar to that for making conventional diaphragm walls. An excavation is made in the ground and filled with a liquid known as "mud", and generally based on bentonite. The mud forms a waterproof deposit on the walls of the excavation, thus enabling it to control percolation through the ground and prevent the walls collapsing. Once the excavation has reached the desired depth, it is progressively filled with concrete, beginning underneath the mud, in the bottom of the excavation.

In order to reach the desired concreting depth and in the particular situation of so-called "deep" concreting, it is common practice to use a concreting column constituted by a plurality of column elements or segments assembled to one another.

The various segments are assembled together progressively as the column is lowered inside the excavation.

Concreting begins when the bottom end of the column is close enough to the bottom of the excavation.

The first step, generally referred to as "priming", consists in filling the concreting column with concrete by replacing the mud that was initially present with concrete, but without polluting the concrete with mud.

After concrete has filled a predetermined volume of the excavation, the feed of concrete to the column is stopped, the column is raised through a height substantially equal to the length of a segment, and its top end segment is removed. This operation is referred to as "shortening" the column.

While concreting is stopped in order to shorten the column, pressures inside the column and in the remainder of the excavation are balanced, with the top surface of the concrete inside the column moving down. When concreting is restarted, concrete poured into the inlet of the column drops through air over a considerable height. This drop, and/or sudden contact between the newly poured-in concrete and the concrete at the bottom of the column can give rise to segregation of the concrete and possibly to the formation of a plug inside the column, thereby preventing operations from being continued.

Dropping concrete over a large height can also lead to air being held captive under pressure inside the column, which can lead to concrete being discharged from the top end of the column while the air is being expelled, thereby constituting a potential risk for the safety of operators, or from the bottom end of the column, thereby leading to a reduction in the quality of the concrete.

The problem of concrete drop height also arises during the priming stage, and independently of any operations of raising the column, as soon as the feed of concrete to the column is not continuous.

OBJECT AND SUMMARY OF THE INVENTION

It is now desired to improve the conditions of deep concreting in order to avoid the phenomena of concrete segregation and of plugs forming in the concreting column, and to limit risks for personnel.

This object is achieved with a concreting installation adapted to concrete an excavation, in particular an excavation presenting a depth of not less than 100 meters, said installation comprising:

a concreting column having a top end arranged to be open in order to be at atmospheric pressure; and at least one controlled retention device situated at a distance from the open top end of the concreting column and adapted, in at least one configuration, to retain a volume of concrete inside said column.

By means of the controlled retention device, the flow of concrete or drilling mud inside the column and/or the flow of concrete or mud at the outlet from the concreting column can be controlled depending on requirements.

The installation is thus advantageously configured to enable the height of an empty space defined between the volume of concrete retained inside the column and one of the ends of the concreting column to be controlled.

The maximum drop height for concrete inside the column is thus constantly maintained below a predetermined limit value, preferably equal to 40 meters.

In the present description, the term "retention device" is used to mean a device that makes it possible, in at least one configuration, to block the flow of concrete or mud inside the column or to the outside of the column, either totally or partially. In particular, the device is adapted to constrict the flow section for concrete or mud inside the column or to the outside of the column.

The retention device is generally remotely controlled. It is thus adapted to be actuated to pass from at least one passive position in which it defines a working flow section for concrete or mud inside the column or to the outside of the column, to at least one axial position in which it defines a flow section for concrete or mud that is smaller than the working section, and vice versa. As mentioned above, the flow section when the retention device is in its active position may be zero (total blocking) or non-zero (partial blocking).

In the present description, it is thus said that a volume of concrete is retained when the movement of the volume inside the column is prevented or braked by a retention device.

In the present description, and unless specified to the contrary, an axial direction is a direction parallel to the main axis of the concreting column. In addition, a radial direction is a direction perpendicular to the main axis and intersecting it. Unless specified to the contrary, the adjectives and adverbs "axial", "radial", "axially", and "radially", are used with reference to the above-mentioned axial and radial directions.

Unless specified to the contrary, the adjectives "inner", "inside" and "outer", "outside" are used with reference to a radial direction such that an inner/inside portion of an element is closer to the main axis than an outer/outside portion of the same element.

In addition, unless specified to the contrary, the adjectives "top" and "bottom" are used relative to the axis of the concreting column, which is generally positioned vertically while it is in use, the bottom end of the column being inserted into the excavation and the top end of the column being towards the inlet of the excavation.

As explained above, the concreting column may be made up of a plurality of column segments that are assembled to one another in the axial direction.

By way of example, the total length of the column (measured in the axial direction), in other words its maximum length, possibly as obtained by assembling together a plurality of column segments, may be greater than 100 meters.

In an aspect of the invention, at least one retention device is arranged in the vicinity of the bottom end of the concreting column.

In the present description, it is generally considered that an element is arranged in the vicinity of the bottom end of the concreting column when it is situated at a distance from the bottom end that represents no more than 20%, preferably no more than 5%, more preferably no more than 2% of the total length of the column.

Under such circumstances, the retention device is controlled in such a manner that the height of the volume of concrete that it retains inside the column remains constantly greater than a predetermined value, the result being that the distance between the opening of the column at its top end and the free surface of the volume of concrete inside the column remains less than a limit value, which is less than or equal to the limit drop height for concrete.

In an example, the concreting column presents at least one outlet orifice in the vicinity of its bottom end, and the retention device comprises at least one movable valve member adapted to be moved relative to said outlet orifice.

By moving relative to the outlet orifice, the valve member can in particular modify the flow section for the concrete or for the mud during the initial priming stage, to the outside of the concreting column.

In an example, the outlet orifice of the concreting column opens out axially, and the valve member is movable in translation in the axial direction.

In another embodiment, the valve member comprises a tube having the same axis as the concreting column, at least one of the concreting column and the tube having at least one lateral opening, and the tube is adapted to be moved relative to the concreting column in such a manner as to modify the flow section for the concrete flowing out from the concreting column through said lateral opening.

The tube may be mounted to turn relative to the concreting column. In a variant, it may be mounted to move in translation relative to the concreting column, along the axis of the concreting column.

In an advantageous provision, the tube presents a length measured in the axial direction that is substantially shorter than the length of the column, being no greater than 20%, preferably no greater than 5%, still more preferably no greater than 2% of the total length of the column.

In embodiments, the tube may be arranged radially inside or outside the concreting column.

In a particular embodiment, the concreting column has at least one first lateral opening and the tube has at least one second lateral opening, and the concreting column and the tube are adapted to be moved so that the first and second openings are positioned facing each other in at least one configuration of the installation.

In an example, the installation has at least one actuator mechanism for actuating the retention device, situated in the vicinity of the bottom end of the concreting column. The actuator mechanism may then be remotely controlled.

In particular, the above-defined valve member may be actuated by an appropriate actuator mechanism situated in the vicinity of the bottom end of the column, in particular at least one actuator or a cable.

In another aspect of the invention, at least one retention device is arranged in the column at a distance from the top end of the column that is less than 80% of the total length of said column. The retention device then forms a level where the concrete is in particular stopped or braked, prior to continuing its descent inside the column. The drop height of the concrete is reduced, thereby reducing risks of segregation.

Preferably, at least one retention device is situated in the top portion of the column.

In the present description, it is also generally considered that the top portion of an element such as the concreting column corresponds to the top half of that element in the axial direction.

In the same manner, the bottom portion of an element such as the concreting column generally means its portion situated in its bottom half in the axial direction.

It should be observed that it is also possible, without going beyond the ambit of the invention, to provide at least one first retention device in the vicinity of the bottom end of the column and at least one second retention device situated higher up in the column, in particular at a distance from the top end of the column that is less than 80% and preferably less than 50% of the total length of said column. Such an arrangement makes it possible in particular for the load associated with the concrete retained inside the column to be distributed over a plurality of retention devices.

In a particular implementation, the concreting installation has a plurality of retention devices distributed along the concreting column and adapted to be controlled independently of one another. The progress of concrete inside the column then takes place in successive stages, that are spaced apart by a distance that is less than or equal to the limit drop height desired for the concrete.

In an embodiment of the invention, a hydraulic or pneumatic valve, and in particular a sleeve valve is used as a retention device.

Advantageously, in the vicinity of its bottom end (and in particular its outlet orifice), the concreting column includes a guide and abutment element for concrete, which element is provided with a pointed working end for breaking up any clusters of gravel in the concrete.

The concreting installation may also include a priming piston adapted to slide along the concreting column. The priming piston may be of various shapes, in particular it may be spherical or cylindrical in shape. It provides separation between mud and concrete inside the column during the priming stage. It can ensure that mud does not rise and impede the descent of concrete inside the column, and that it does not pollute the concrete.

In an embodiment, the priming piston may naturally be placed on the retention valve member situated at the bottom end of the concreting column so as to end up constituting a guide and abutment element for concrete in the vicinity of the outlet orifice.

In an example, the concreting installation further includes means for discharging air held captive in a column segment so as to avoid any risk of concrete being expelled from the top end of the column.

By way of example, the discharge means comprise an air pipe in communication with said segment of the concreting column.

It should be observed that these means may be arranged outside or inside the column.

In an advantageous embodiment, the air discharge system comprises a pipe extending axially inside the concreting column. Under such circumstances, the pipe is movable and can also perform the function of the device for measuring the flow rate inside the concreting column.

In a provision of the invention, the concreting installation includes at least one measurement and/or calculation device for measuring and/or calculating a parameter representative of the advance of concreting.

In particular, the installation advantageously includes at least one measurement and/or calculation device for measuring and/or calculating at least one parameter representative of the level of concrete inside the concreting column. By means of such a device, it is possible to determine the moment at which the flow section of the concreting column needs to be constricted, and by how much, prior to raising said column in the excavation, such that the height of the empty space defined between the volume of concrete contained in the concreting column and the top end of the concreting column remains less than the limit value while the column is being raised.

Advantageously, the measurement and/or calculation device is adapted to measure the level of concrete directly. For example, it may be in the form of a float or a sounding lead.

It should be observed that the measurement and/or calculation device may be operated continuously or from time to time during the concreting method.

In addition, or as an alternative, the concreting installation may include one or more of the following means, for example:

means for measuring the length of the column and the position of its bottom end in the excavation;

means for measuring the level of concrete in the excavation;

means for measuring the flow rate of concrete and/of mud inside the column;

means for measuring and/or calculating the volume of concrete that has already been inserted into the excavation; and means for measuring and/or calculating the forces used for extracting the concreting column.

The values obtained for these parameters are advantageously stored and processed in a computer in order to control the process.

In an example, the installation includes an automatic control unit for controlling the retention device(s).

In an advantageous provision, the control unit is connected to the measurement and/or calculation device(s), and is adapted to control said retention device(s) as a function of the values of the parameter(s) as measured and/or calculated by the measurement and/or calculation device(s).

The present description also relates to a concreting machine, including a concreting installation as defined above, a support structure, and support and guide means for the concreting column that are secured to the support structure.

In an example, the support and guide means comprise a guide and support mast secured to the support structure, a rotary system movable along said guide mast, and a clamping device for clamping the concreting column.

Advantageously, the concreting machine also has means for putting into place, removing, and storing column elements.

The present description also relates to a method of concreting an excavation, in particular an excavation presenting a depth of not less than 100 meters, said method comprising at least the following succession of steps:

placing a concreting column in the excavation for concreting; and performing a concreting cycle during which concrete is inserted into the concreting column via its open top end, and a volume of concrete is retained at a distance from said open end so that the height of an empty space defined between said volume of concrete and one of the ends of the concreting column remains less than a limit value.

The term "empty space" is used herein to mean a continuous space extending over an axial fraction of the column and not containing concrete, but filled with air or mud during the priming stage. It can be understood that an empty space is a space into which concrete can move merely under the effect of its own weight.

The height of an empty space thus corresponds to the drop height of concrete when performing the method.

In the invention, a volume of concrete is thus retained inside the column so that the drop height for this volume of concrete or for some other volume of concrete inside the column remains less than a predetermined value.

Preferably, the predetermined limit value is equal to 40 meters. Beyond this limit value, the drop of concrete and/or the sudden contact between the concrete being poured in and the concrete at the bottom of the column can lead to segregation of the concrete and possibly to the formation of a plug inside the column, thereby preventing operations from being continued.

In order to retain the volume of concrete, the flow section inside the concreting column and/or to the outside of said column may, for example, be constricted at least in part, and preferably in full. To do this, it is possible, for example, to operate a retention device so that, depending on requirements, it passes from a passive position in which it defines a working flow section inside the column or to the outside of the column, to an active position in which it defines a flow section that is smaller than the working section, or vice versa.

In particular, an outlet orifice of the concreting column situated in the vicinity of its bottom end may be closed at least in part.

In an implementation, the first concreting cycle comprises a priming step during which concrete is inserted via the open top end of the concreting column filled with drilling fluid, so as to expel the drilling fluid from the column and fill the concreting column with concrete, and during the priming step, the flow section inside the concreting column and/or to the outside of said column is constricted in part. The descent of concrete inside the concreting column is thus braked, and the phenomena of concrete segregation and of the resulting plugs are avoided. In an example, at the end of the first concreting cycle, the concreting column is raised inside the excavation, and then a second concreting cycle is performed. Several concreting cycles can thus follow one another until the column has been raised completely and the excavation has been concreted in full.

When the concreting column is formed by a plurality of column elements, a column element may be removed from the top end of the column at the end of a concreting cycle and prior to beginning the next cycle.

The concreting method may be automated, in full or in part. For example, it is possible to cause the retention device(s) to open as a function of the level of concrete in the column. Raising of the column may be controlled as a function of the height of concrete in the excavation. In addition, stopping concreting, operating the retention device(s), removing a column element, and/or restarting concreting may all be performed automatically, at least in part.

In an implementation, the above-defined empty space is situated above the volume of concrete. Under such circumstances, the concreting installation generally includes at least one retention device in the vicinity of the bottom end of the concreting column. The retention device is then controlled so as to limit the flow of concrete leaving the column, or so as to stop it completely, thereby avoiding the level of concrete inside said column decreasing excessively, which would provide an empty space of excessive height for the next concreting operation, in an upper portion of the column.

By way of example, a concreting cycle comprises the following steps:

a) introducing concrete via the open top end of the concreting column;

b) once a given volume of concrete has been inserted into the excavation, stopping the feed of concrete to the concreting column; and c) constricting the flow section inside the concreting column and/or to the outside of said column at least in part, and possibly in full, as a function of at least one parameter representative of the level of concrete inside the concreting column.

During step a), the flow section inside the concreting column and/or to the outside of the column is advantageously as large as possible. If this flow section has decreased during the priming step or during step b) of a preceding cycle, it is preferably increased once more.

Generally, during the concreting cycle, at least one parameter representative of the level of concrete inside the excavation is measured and/or calculated (continuously or from time to time), and as a function of this at least one parameter, the moment is determined when the feed of concrete to the concreting column needs to be stopped.

In order to ensure that the excavation is properly filled with concrete, it is appropriate for the bottom end of the concreting column to be immersed continuously in concrete during concreting. Nevertheless, it is generally preferred for the length of column that is immersed in concrete to remain within a certain range of values, e.g. in the range 3 meters to 10 meters.

Generally, during the concreting cycle, at least one parameter representative of the level of concrete inside the concreting column is measured and/or calculated (continuously or from time to time), and as a function of this at least one parameter, the flow section of the concreting column is constricted (in particular the moment and/or the amount of constriction is/are determined), so that the height of the empty space defined between the volume of concrete contained in the concreting column and the top end of the concreting column remains less than the limit value.

In an example, at the end of step c) of the first concreting cycle, the concreting column is raised inside the excavation with the height of the empty space defined between the volume of concrete retained in the concreting column and the top end of the concreting column continuing to remain below the limit value, and at least one second concreting cycle is performed at the end of the first concreting cycle.

It should be understood at this point that the flow section inside the concreting column and/or to the outside of said column is constricted in step b) in such a manner that even while the column is being raised inside the excavation and pressure differences arise between the inside of the column and the excavation, the drop height of concrete (height of the empty space) remains less than the desired limit value.

It is thus possible to shut the concreting column at least in part between its top and bottom ends, and in particular between its inlet and outlet orifices.

In an implementation, the empty space is situated beneath the volume of concrete. Under such circumstances, at least one retention device is generally situated at a distance from the bottom end of the column and forms at least one level for retaining concrete. An empty space can then be defined between the retention device and the free surface of the concrete situated in the column, downstream from said retention device, or between a first retention device and a second retention device, if there are two or more.

Under such circumstances, and advantageously, the air present in the empty space is discharged in order to control pressure.

In a particular implementation, during a concreting cycle, a volume of concrete is retained in succession at at least two retention points that are spaced apart axially inside the concreting column, an empty space being defined between said first and second retention points.

Several embodiments and implementations are described in the present description. Nevertheless, unless specified to the contrary, characteristics described with reference to any one embodiment or implementation may be applied to other embodiments or implementations.

BRIEF DESCRIPTION OF THE DRAWINGS

The invention can be better understood on reading the following description of embodiments of the invention given as non-limiting examples and with reference to the accompanying drawings, in which:

FIG. 1A shows a concreting machine 100 of the invention, adapted for concreting an excavation E as shown, of height H1 that in this example is equal to at least 100 meters and is filled with a drilling fluid F of the bentonite mud type.

Figure 1A:
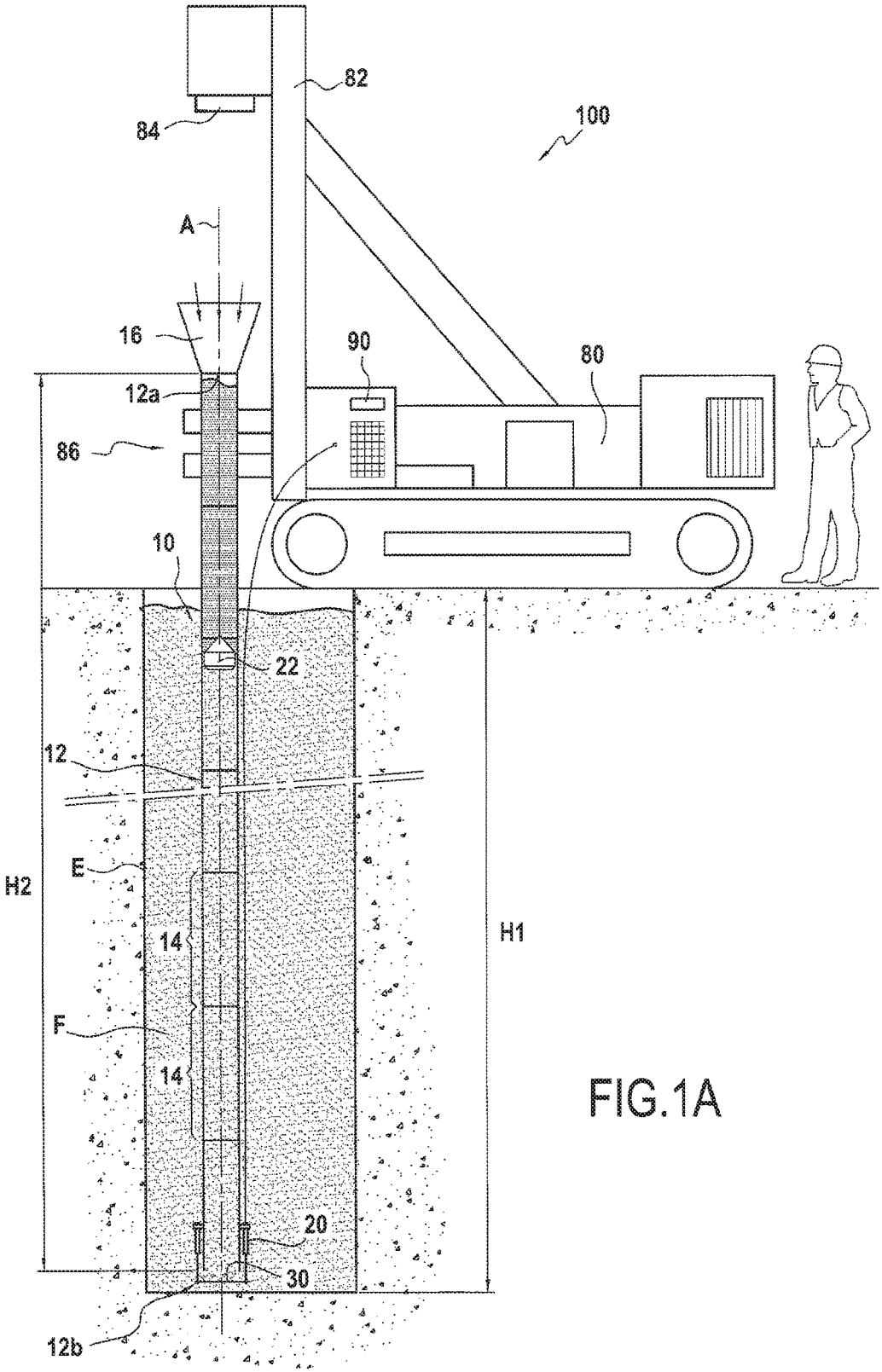
FIGS. 1A to 1D show various steps of a concreting method performed using a concreting installation in a first embodiment of the invention.

The concreting machine 100 comprises a concreting installation 10 provided with a concreting column 12 of axis A, whereby concrete is introduced into the excavation.

It also has a support structure 80 having mounted thereon support and guide means for the concreting column 12, which means in this example are constituted by a guide mast 82, a rotary system 84 that is movable along the guide mast 82, and a device for clamping the concreting column 86, in this example in the form of a double guillotine. Other equipment is mounted on the support structure 80, such as a control unit 90.

In order to reach the desired concreting depth, the column 12 is made up of a plurality of column elements 14 mounted in succession one after another along the axial direction A. By way of example, the connection between two successive elements 14 may be provided by screwing a threaded end of one of the elements into a complementary tapped end of the second element. Such a connection can be made or undone in conventional manner using the clamping device 86.

In FIG. 1A, the concreting column 12, formed by a plurality of column elements 14, is held at its top end by the clamping device 86, while its bottom end is located in the vicinity of the bottom of the excavation E. Its total height H2 is not less than the height H1 of the excavation.

As can be seen in FIG. 1A, the column 12 is open and is fitted with a funnel 16 at its top end, and it is provided with an outlet 18 opening out axially at its bottom end.

In accordance with the invention, the installation 10 has a controlled retention device adapted to retain a volume V of concrete inside the column 12, as described in greater detail below.

Figure 2A:
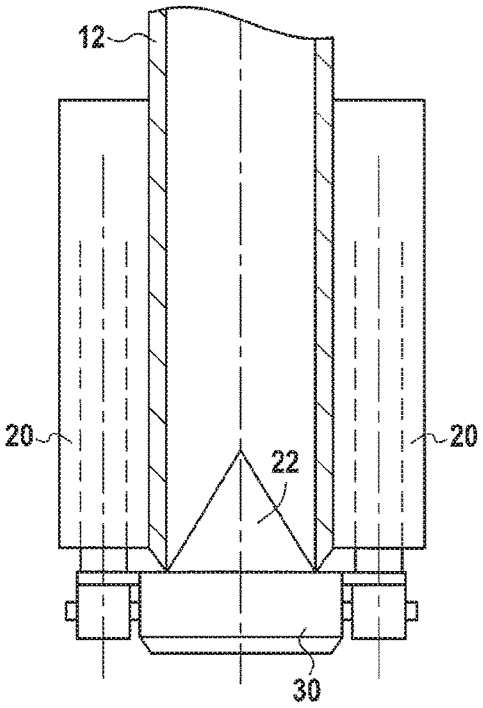
FIGS. 2A and 2B show in greater detail the valve member of FIGS. 1A to 1D, respectively in the closed state and in the open state.
Figure 2B:
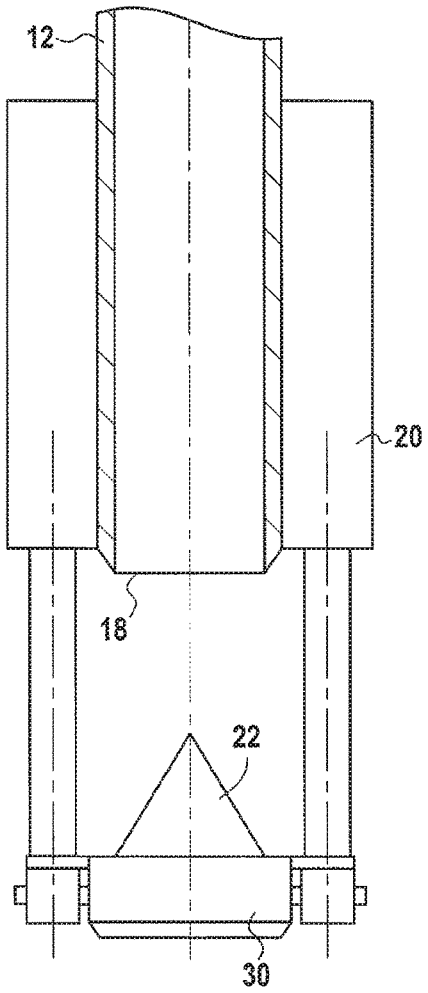

FIGS. 2A and 2B show in greater detail the bottom end of the FIG. 1A column 12 fitted with this retention device.

In the example shown, the retention device comprises a valve member 30 mounted to move in translation relative to the column 12 in the axial direction so as to be capable of occupying a closed position in which the outlet orifice 18 is completely shut, an open position in which the flow section through the outlet orifice 18 is at a maximum, and possibly a partially open position in which the flow section is not zero but is smaller than that obtained in the open position.

FIG. 2A shows the valve member 30 in the closed position. It is moved to the open position of FIG. 2B by means of two hydraulic actuators 20 connected to the control unit 90 secured to the support structure. These arrangements are nevertheless not limiting, and the valve member may be actuated by any other appropriate controlled actuation mechanism, in particular electric actuators or cables.

The various steps of a concreting method of the invention using the above-described installation 10 are described below with reference to FIGS. 1A to 1D.

In an initial state, the concreting column 12 is filled with drilling mud F, as is the excavation E. The valve member 30 is in a partially open position, with the flow section through the outlet orifice 18 being small.

FIG. 1A shows the priming stage, which consists in replacing the mud F initially present in the concreting column 12 with concrete.

In order to avoid the concrete being polluted by the mud F during this stage, a plug constituting a priming piston 22 is previously placed at the surface of the mud, inside the column 12. The concrete is thus continuously separated from the mud.

By means of the valve member 30 partially shutting the outlet orifice 18 of the column 12, the flow of mud out from the column 12 is limited, thereby braking the descent of concrete. This serves to avoid concrete segregation phenomena and the resulting plugs. If the outlet orifice 18 were not partially shut, the concrete would descend inside the column 12 in abrupt manner because of the difference in density between concrete and mud, thereby giving rise to the above-mentioned undesirable phenomena.

Once the column 12 is full of concrete, the valve member 30 is put into the open position by the control unit 90 and the excavation E begins to be concreted at a controlled rate.

Figure 1B:
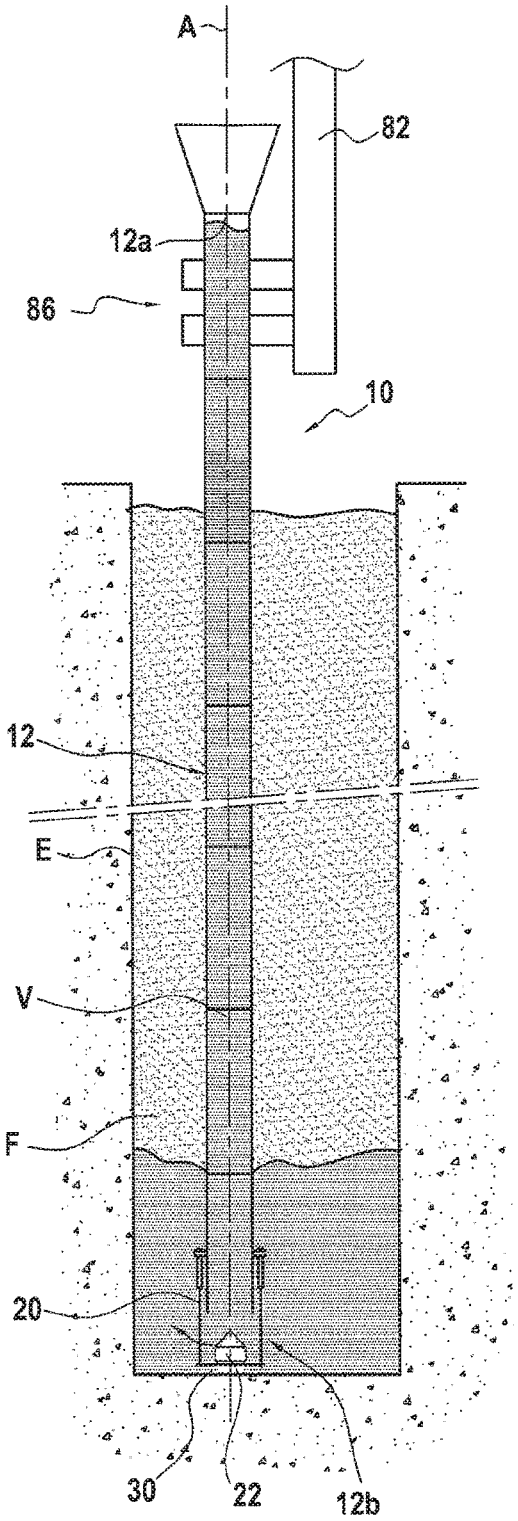

In FIG. 1B, it can be seen that the priming piston 22 is placed against the top face of the valve member 30, where it is to stay until the end of concreting of the excavation. In this position, the priming piston performs a novel guidance and abutment function for the concrete. Provided with a working top end that is pointed, it breaks up any clusters of gravel contained in the concrete and reaching the outlet orifice 18.

After concrete has filled a predetermined volume of the excavation E, and for a predefined height of concrete remaining in the column, the feed of concrete to the column 12 is stopped.

At this instant, an empty space of height H3 is defined between the top end of the column and the free surface of the concrete inside the column, and the valve member 30 is moved into its closed position.

Figure 1C:
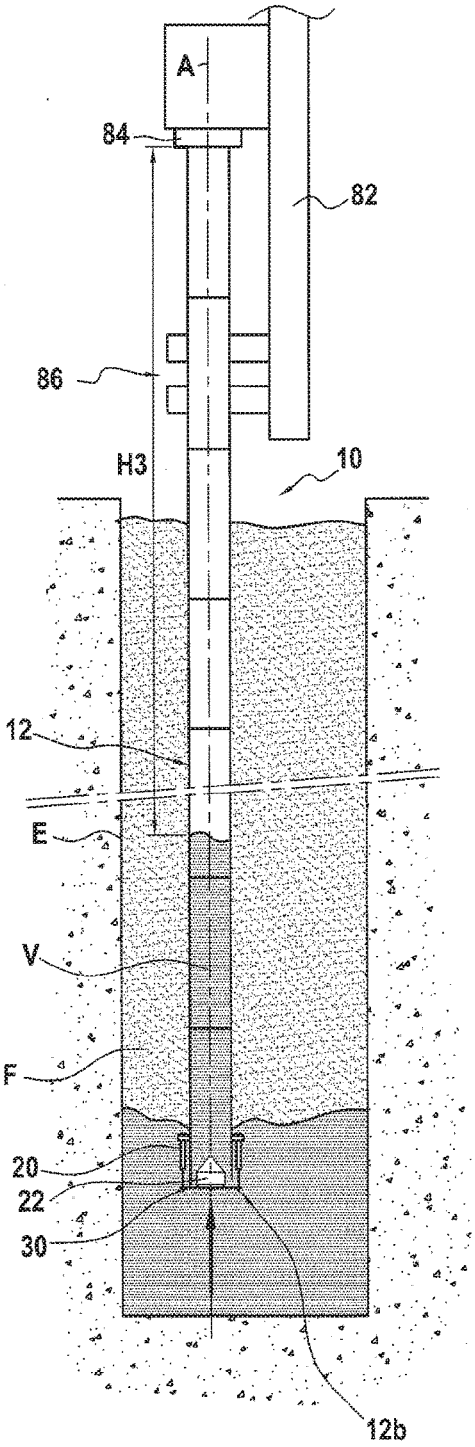

As shown in FIG. 1C, the funnel 16 is then separated from the top end of the column 12, which is then fastened to the rotary head 84, with the column 12 being raised along the mast 82 through a height substantially equal to the length of a column element 14, and then the element 14 at the top end is removed, and the funnel is put back into place at the top end of the now-shortened column.

Since the valve member 30 is in the closed position, the flow rate of concrete at the outlet from the column is zero, and the height of concrete inside the column remains unchanged.

Figure 1D:
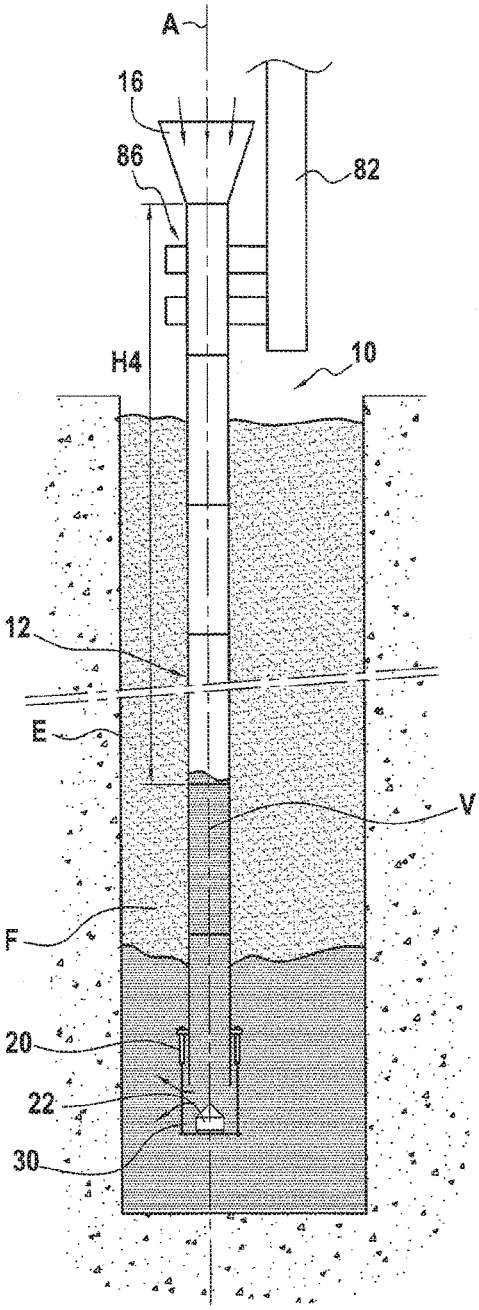

Once the column 12 is once more held in place in the excavation E by means of the clamping device 86, the valve member 30 is moved into its open position, as shown in FIG. 1D, and concreting is continued.

The concrete poured into the funnel 16 then drops inside the empty space over a height H4 corresponding to the height H3 minus the height of the column element that was reduced when shortening the column. The first concreting cycle is stopped and the valve member 30 is controlled in such a manner that this height H4 does not exceed the acceptable limit height for dropping concrete, which is generally about 40 meters.

The sequence of FIGS. 1C and 1D is repeated as often as necessary in order to concrete the entire excavation E.

During these operations, one or more measurement and/or calculation devices serve to detect one or more parameters representative of the advance of the concreting. These may comprise in particular:

means for measuring the length H2 of the column 12 and the position of its bottom end 12*b* in the excavation E;

means for measuring the level of concrete inside the excavation E and inside the column 12;

means for measuring the flow rate of concrete and/or of mud inside the column 12;

means for measuring and/or calculating the volume of concrete that has already been inserted into the excavation E; and means for measuring and/or calculating the forces needed for raising the concreting column 12.

The values obtained for the above-mentioned parameters are advantageously transmitted to the control unit 90, which processes them in order to control the process and which opens and closes the valve member 30 as a function thereof.

In particular, provision may be made for the control unit 90 to include a computer and for it to display continuously a curve giving the height of concrete inside the excavation E as a function of the volume of concrete that has already been inserted into the column. While also taking account of the position of the bottom end 12*b* of the column 12 inside the excavation E, the control unit can then cause concreting operations to be stopped and can trigger a new shortening of the column, in such a manner that the height H4 that concrete drops in the empty space inside the column, when concreting is restarted, remains less than the predetermined limit value.

It should be observed that although this is not shown, the concreting installation 10 could equally well include a system for handling and storing column elements 14 and/or a system for handling and screwing/unscrewing the funnel 16.

The operations of monitoring and controlling the retention device, of shortening the column, and also of stopping and restarting concreting operations could also be performed manually, by an operator, as a function of parameters measured by one or more measurement and/or calculation devices of the above-specified types.

The retention devices may be of shapes other than the above-described valve member 30. FIGS. 3A, 3B, 4A to 4C, and 5A, 5B show a few variants.

Figure 3A:
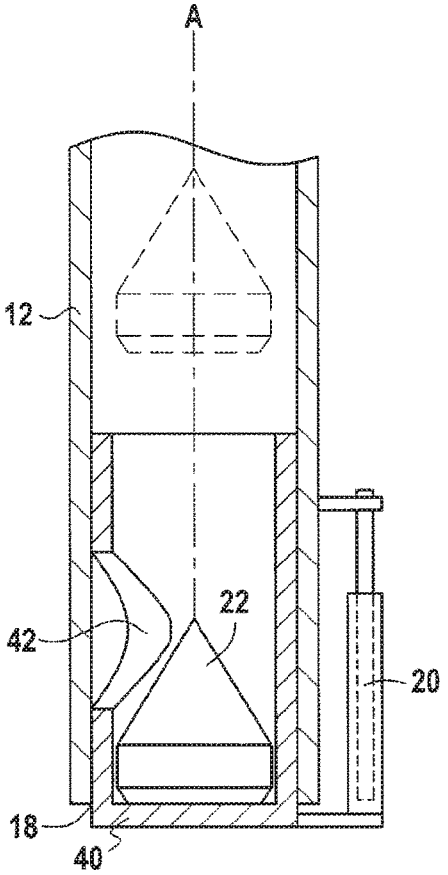
FIGS. 3A and 3B show a second example of the retention device that can be used in the invention.
Figure 3B:
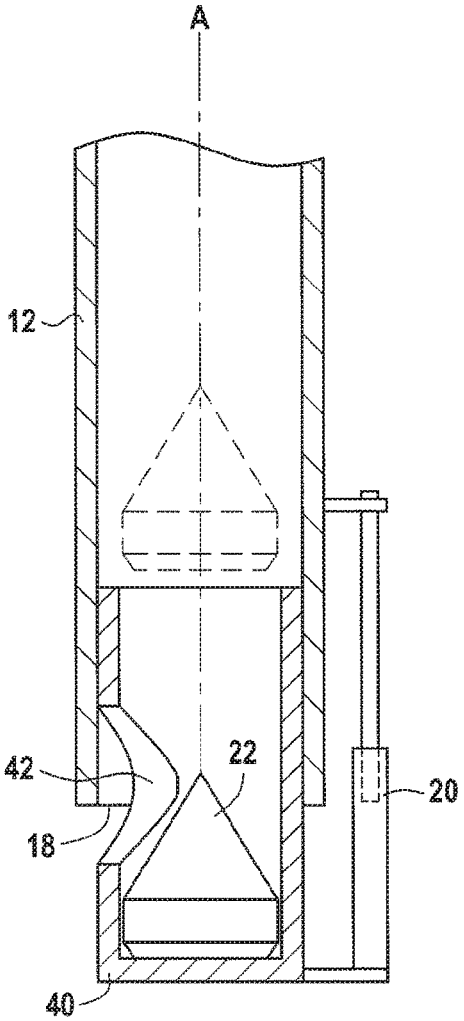

FIGS. 3A and 3B show the bottom end of a concreting column 12 of the above-described type.

As in the above example, the bottom end of the column 12 presents an outlet orifice 18 that opens out axially.

In this example, the retention device is formed by a tube 40 that is coaxial with the concreting column 12, being mounted inside said column 12, and that is movable in translation along the axial direction A, specifically by actuating an actuator 20.

The tube 40 presents an axial length that is substantially shorter than the total length of the column (i.e. its maximum length), and in particular a length that is no more than 20%, and preferably no more than 5%, or more preferably no more than 2% of the total length of the column.

It is closed at its axial end furthest from the top end of the column 12, and it is opened at its opposite end. When it is fully inserted inside the column, as shown in FIG. 3A, the tube 40 totally closes the outlet orifice 18 of the column.

A lateral opening 42 is formed in the side wall of the tube 40. The opening 42 is arranged in such a manner that an axial movement of the tube 40 away from the column 12 serves to uncover the opening 42, at least in part, as shown in FIG. 3B and serves to allow concrete and/or mud leaving through the orifice 18 to pass to the outside of the column 12.

Figure 4C:
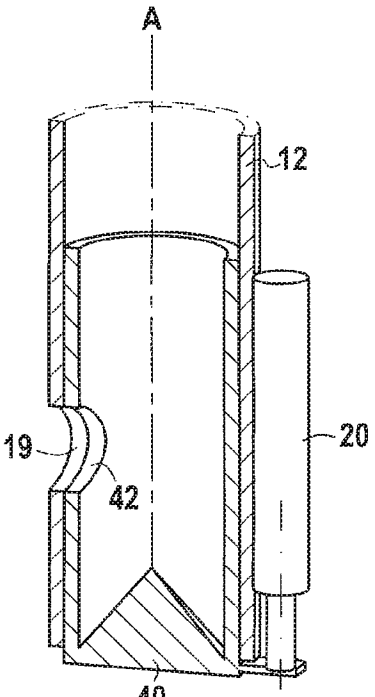
FIGS. 4A to 4C show a third example of the retention device.
Figure 4B:
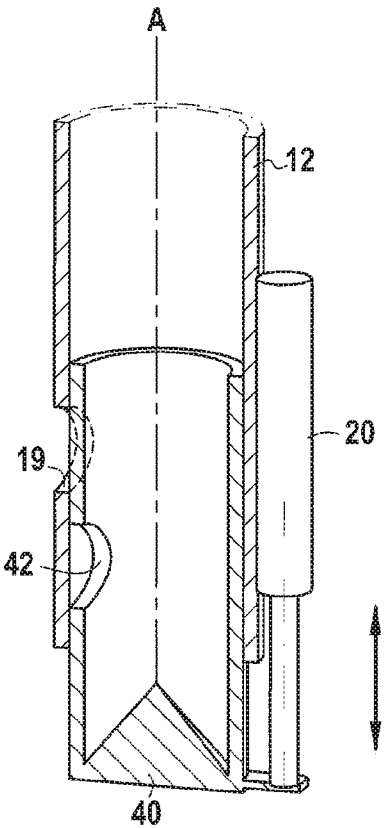
Figure 4A:
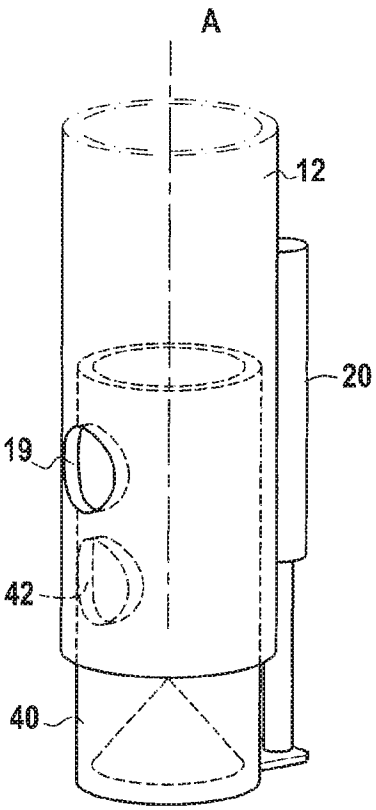

In a second variant shown in FIGS. 4A to 4C, the retention means are similar in shape to the preceding variant, but the concreting column 12 now has an outlet opening 19 formed in its side wall.

In this example, the valve-forming tube 40 is adapted to be moved axially relative to the column 12, specifically by means of an actuator 20, so that the axial openings of the tube and of the column, given respective references 42 and 19, are positioned facing each other in at least one configuration of the installation as shown in FIG. 1C, and so that the flow section through the axial opening 19 of the column 12 can be modified by moving the tube 40 relative to the column 12.

In the position shown in FIGS. 4A and 4B, the lateral opening 19 of the column 12 is shut by the side wall of the tube 40. The flow section through the lateral outlet opening 19 is zero.

In contrast, in the position shown in FIG. 4C, the lateral opening 19 of the column 12 faces the lateral opening 42 in the tube 40. Concrete and/or mud contained in the column 12 can escape therethrough via said openings 19, 42.

Figure 5A:
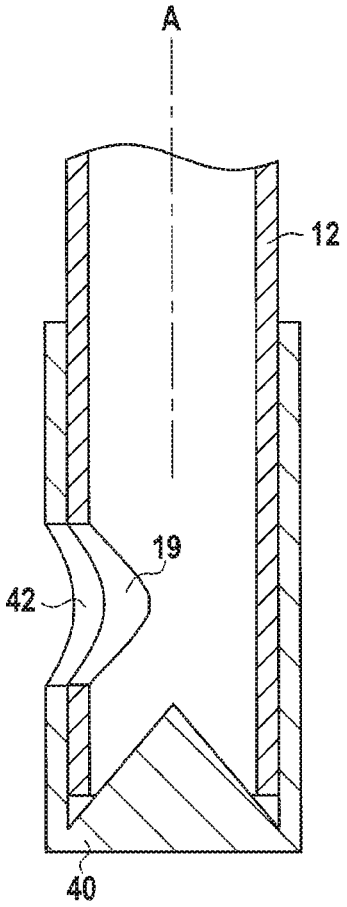
FIGS. 5A and 5B show a fourth example of the retention device.
Figure 5B:
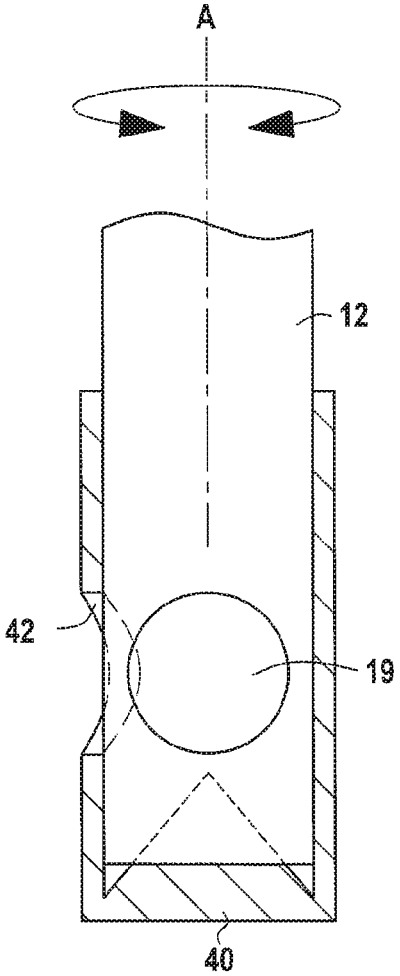

In the variant shown in FIGS. 5A and 5B, the retention device is formed by a tube 40 that is coaxial with the column 12, but this time mounted on its outside. As in the preceding variant, the concreting column 12 has a lateral opening 19 and the tube 40 has a lateral opening 42. In this example, the tube 40 is mounted to be movable in turning about the axis A.

On being moved relative to the column 12, the tube 40 can go from a position as shown in FIG. 5A in which the lateral opening 42 and 19 of the tube 40 and of the column 12 face each other, allowing concrete and/or mud to pass, to a position as shown in FIG. 5B, in which the openings 42 and 19 overlap not at all or in part only, thereby defining a flow section that is smaller than in the preceding position, and possibly a flow section that is zero.

Figure 6A:
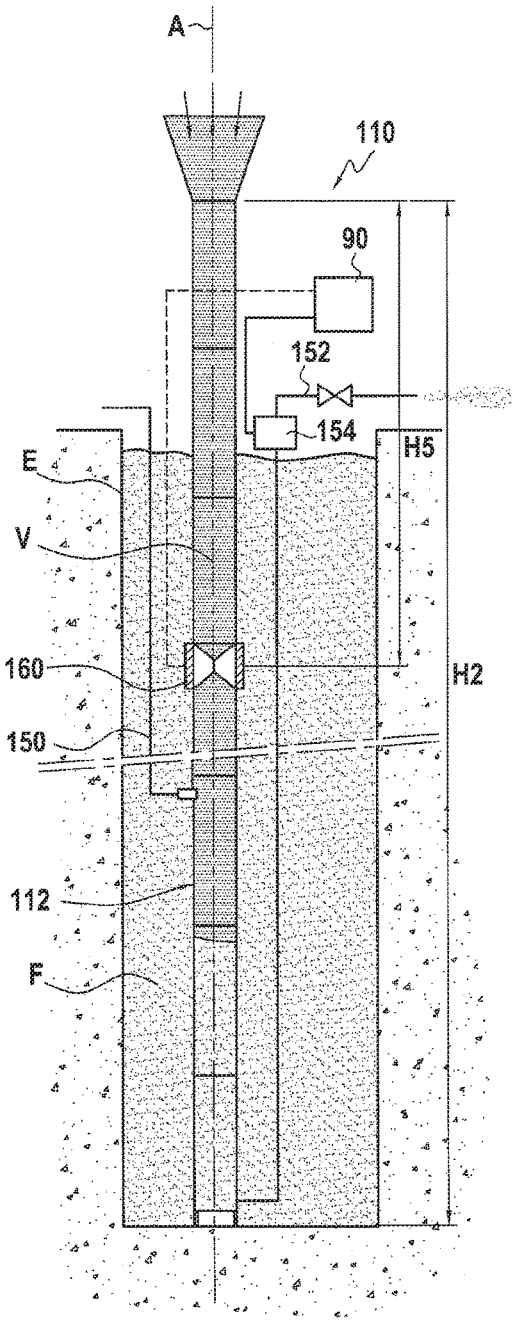
FIGS. 6A and 6B show a concreting installation in a second embodiment of the invention.
Figure 6B:
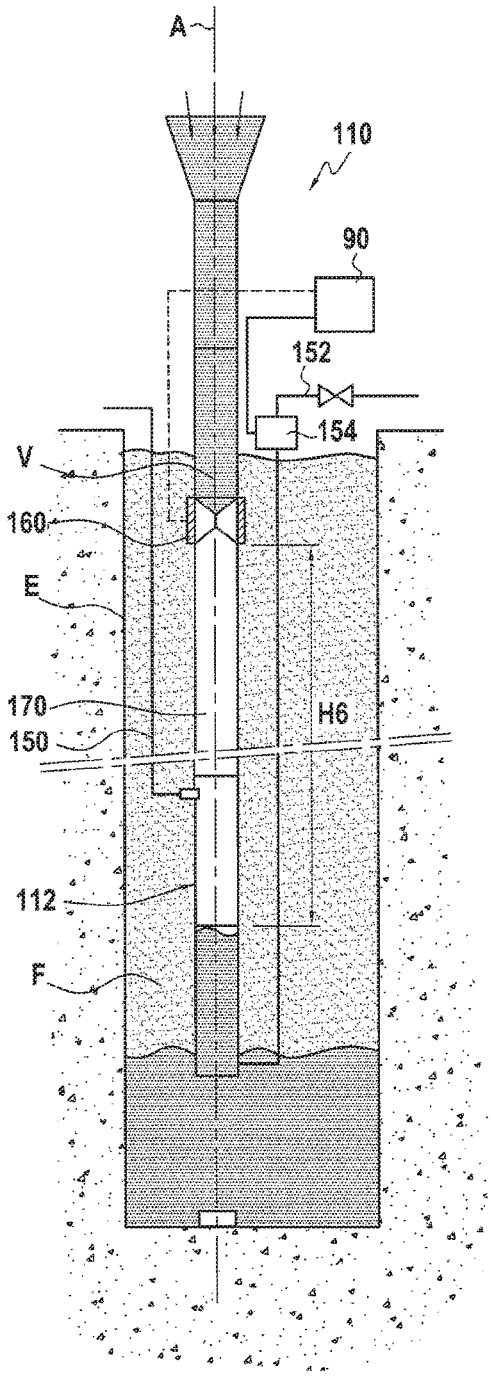

FIGS. 6A and 6B show a concreting installation 110 in a second embodiment of the invention.

As in the above embodiment, the concreting installation 110 has a concreting column 112 of axis A, through which concrete is inserted into the excavation E.

It may also have a support structure, support and guide means for concreting column, and other items of equipment as described with reference to the first embodiment. The characteristics described with reference to FIG. 1 are not repeated at this point for reasons of concision, but they remain applicable to this second embodiment.

The concreting column 112 has a concrete retention device in its top portion.

In the example, the retention device is constituted by a valve 160, in particular a sleeve valve, well known to the person skilled in the art.

Specifically, the valve 160 forms an intermediate level for retaining the concrete.

With reference to the example of FIG. 6A, the column 112 presents a total height H2. A valve 160 is placed at a distance H5 from the top end of the column 112, where the distance H5 is less than half the total height H2 of the column.

During priming, the valve 160 is partially closed, so as to avoid concrete descending abruptly in the mud-filled column, and in order to avoid the above-mentioned segregation and plug phenomena.

In order to control the descent of the first concrete into the mud when starting concreting, the installation has a device for measuring the flow rate inside the concreting column 112.

In this example, the measurement device includes a height 152 connected to the concreting column in the vicinity of its bottom end and fitted with a flow meter 154, itself connected to the control unit 90.

As shown in FIG. 6A, during the initial stage of concreting (priming), the concreting column 112 is plugged at its bottom end (the bottom end of the column 112 presses against the bottom of the excavation). The mud, pushed by the concrete, is discharged by the pipe 152.

By measuring the flow rate of mud in the pipe 152 by using the flow meter, it is possible to determine how the concrete has advanced inside the column 112. It is thus possible to determine the moment when the column 112 is full of concrete.

At that instant, the column 112 can be moved so that its bottom end is spaced apart from the bottom of the excavation E. The valve 160 is opened. A plug, possibly shutting the bottom end of the column, is disengaged by the weight of concrete, and the excavation is concreted at a controlled flow rate.

As in the above-described embodiment, after concrete has filled a predetermined volume of the excavation, the feed of concrete to the column is stopped, the column is raised through a height substantially equal to the length of a segment, and the top end element is removed.

When concreting is restarted, the valve 160 is put into the closed position, so that the concrete poured into the column is retained at the level of the valve 160. The concrete drop height is equal to the distance H5 minus the length of a column element, and it is selected not to exceed the limit drop height of concrete.

In this state shown in FIG. 6B, an air-filled empty space 170 is defined between the valve 160 and the bottom end of the column, and more precisely between the valve 160 and the free surface of the concrete that remains in the bottom portion of the column at the end of the last concreting cycle.

The valve is then opened, in part or in full, in order to continue concreting. The drop height H6 of the concrete inside the empty space 170 once more does not exceed the predefined limit.

When concreting is restarted, with the valve 160 being opened, the air situated downstream from the valve can be held captive in the concrete at high pressure. In order to avoid any risk of the concrete being expelled from the top end of the column, the concreting installation has means for evacuating the air held captive in a segment of column.

By way of example, the excavation means comprise an air pipe 150 arranged outside the column and communicating with the segment of the concreting column 112 that is situated directly downstream from the valve 160.

Figure 7:
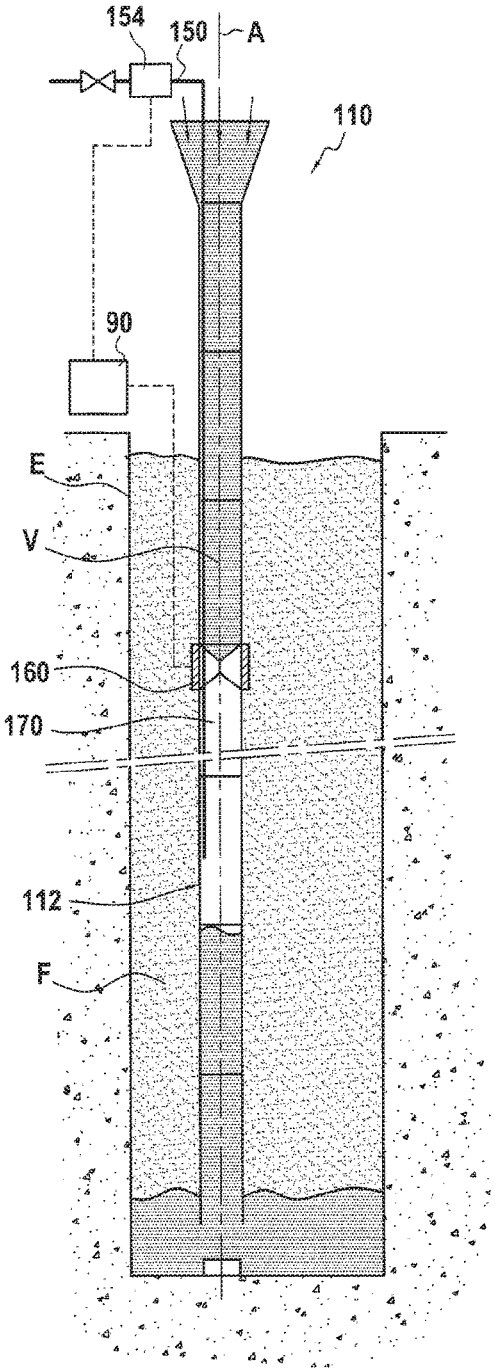
FIG. 7 shows a variant of the second embodiment.

As shown in FIG. 7, the pipe 150 may also extend axially inside the concreting column. Under such circumstances, it may be movable and may include a flow meter 154 for measuring the flow rate of mud inside the concreting column at the time of priming. It thus performs the function of the above-described pipe 152, which can thus be omitted.

Figure 8:
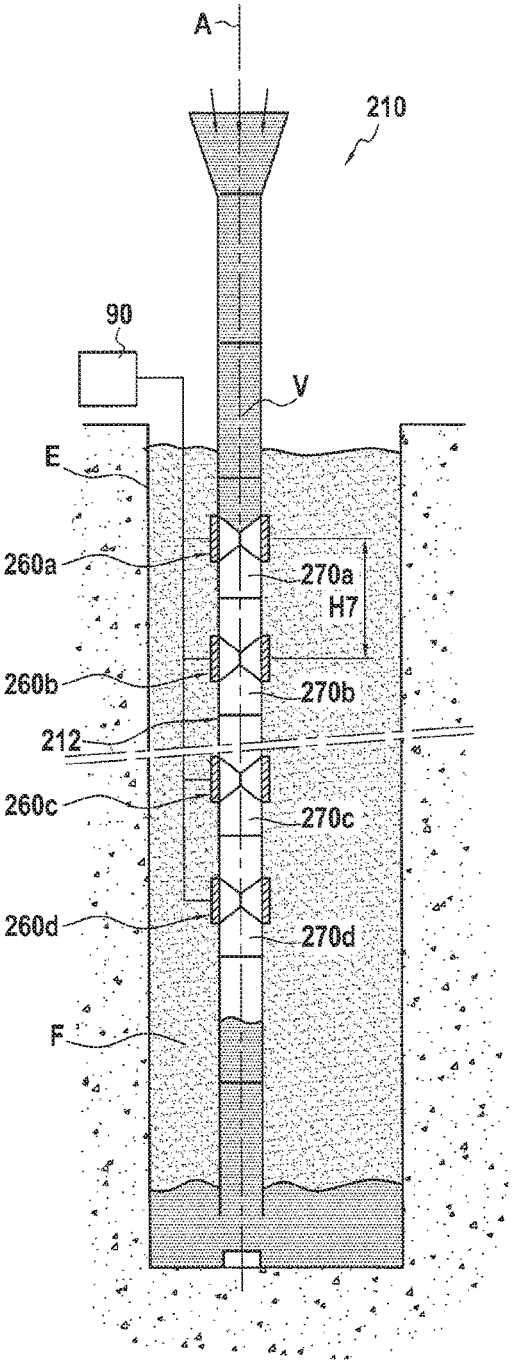
FIG. 8 shows a third embodiment of the invention.

FIG. 8 shows a third embodiment of the invention, in which retention devices are arranged to act during a single concreting cycle to retain concrete at the level of a plurality of retention points that are axially spaced apart inside the concreting column.

For this purpose, a plurality of valves 260*a*, . . . , 260*d* forming retention devices and actuated independently of one another are distributed along the height of the concreting column 212, each valve forming such a retention point, or in other words a level for retaining concrete.

FIG. 8 shows the concreting installation before beginning a second concreting cycle.

The furthest upstream valve 260*a* (i.e. the valve closest to the top end of the column) is in the closed position.

Concrete V, poured into the column, is retained at this valve 260*a*.

If the valve 260*b* situated immediately downstream from the first valve 260*a* is also closed, then an air-filled empty space 170*a* of height H7 is defined between the two valves 260*a*, 260*b*.

When the first valve 260*a* is opened, while the second valve remains in the closed position, the volume of concrete V drops through the height H7, that is selected to be less than the limit drop height of the concrete.

The same principle is applied to the other valves 260*c*, 260*d*, etc., so as to fraction the movement of the concrete inside the column 212 into a plurality of segments of acceptable height.

Although not shown, air discharge means identical to those described above can also be used in this embodiment. In particular, discharge pipes may be provided inside or outside the column and in communication with the segments of the concreting column 212 that are defined by adjacent pairs of valves.

The invention claimed is:

1. A method of concreting an excavation, the method comprising:

placing a concreting column in the excavation for concreting, wherein the concreting column extends between an open top end and a bottom end thereof;

at least partially filing the concrete column with a fluid other than concrete; and performing a first concreting cycle, wherein the first concreting cycle comprises a priming step comprising:

inserting concrete into the concreting column via the open top end to expel the fluid other than concrete from the concreting column;

filing the concreting column with concrete; and retaining a volume of concrete a distance from the open top end such that a height of an empty space, defined between the volume of concrete and one of the open top end and the bottom end of the concreting column, remains less than a predetermined limit value, wherein retaining the volume of concrete comprises at least partially constricting a flow section inside the concreting column and/or to the outside of the concreting column.

2. The concreting method according to claim 1, wherein the empty space is situated above the volume of concrete.

3. The concreting method according to claim 2, wherein the first concreting cycle further comprises:

measuring and/or calculating at least one parameter representative of the level of concrete inside the concreting column; and at least partially constricting the flow section inside the concreting column and/or to the outside of the concreting column as a function of the at least one parameter to retain the volume of concrete such that the height of the empty space defined between the volume of concrete contained in the concreting column and the open top end of the concreting column remains less than the predetermined limit value.

4. The concreting method according to claim 1, wherein the first concreting cycle further comprises:

stopping the introducing of concrete to the concreting column once a given volume of concrete has been inserted into the excavation; and at least partially constricting the flow section inside the concreting column and/or to the outside of the concreting column as a function of at least one parameter representative of the level of concrete inside the concreting column.

5. The concreting method according to claim 1, wherein the empty space is situated beneath the volume of concrete.

6. The concreting method according to claim 5, further comprising discharging air present in the empty space.

7. The concreting method according to claim 1, wherein the predetermined limit value is substantially equal to 40 meters.

8. The concreting method according to claim 1, further comprising:

raising the concreting column inside the excavation after the first concreting cycle; and performing a second concreting cycle.

9. The concreting method according to claim 1, wherein the predetermined limit is less than a height of the concreting column between the open top end and the bottom end.

* * * * *